US007480972B2

(12) United States Patent
Schweinfurth et al.

(10) Patent No.: US 7,480,972 B2
(45) Date of Patent: Jan. 27, 2009

(54) ACTUATOR FOR A CONTROL UNIT

(75) Inventors: Reiner Schweinfurth, Eppingen (DE); Heiner Fees, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 62 days.

(21) Appl. No.: 11/637,797

(22) Filed: Dec. 13, 2006

(65) Prior Publication Data

US 2007/0163541 A1 Jul. 19, 2007

(30) Foreign Application Priority Data

Dec. 30, 2005 (DE) ..... 10 2005 063 021

(51) Int. Cl.
*F02D 11/10* (2006.01)

(52) U.S. Cl. ..... 29/40; 123/396; 74/425; 310/83

(58) Field of Classification Search ..... 29/40, 29/26 A; 74/335, 425; 477/3; 475/155; 123/396, 399, 337; 310/83
See application file for complete search history.

(56) References Cited

U.S. PATENT DOCUMENTS 4,947,815 A * 8/1990 Peter ..... 123/399
6,050,241 A * 4/2000 Reiling ..... 123/396

FOREIGN PATENT DOCUMENTS

DE 4039728 A1 * 6/1992

* cited by examiner

*Primary Examiner*—Dana Ross
(74) *Attorney, Agent, or Firm*—Ronald E. Greigg

(57) ABSTRACT

An actuator for a control unit has a control motor with a motor power takeoff shaft; a control shaft that carries the control unit; and a step-up gear, disposed between the motor power takeoff shaft and the control shaft, as well as a restoring device for restoring the control unit to a basic position if the control motor fails. To make it possible to use a single-stage step-up gear with a major step-up ratio and with advantages in terms of installation space, weight, and production costs, the restoring device has two separate energy-storing means, preferably embodied as restoring springs, of which one feeds back to the motor power takeoff shaft and the other feeds back to the control shaft.

18 Claims, 2 Drawing Sheets

ACTUATOR FOR A CONTROL UNIT

REFERENCE TO FOREIGN PATENT APPLICATION

This application is based on German Patent Application No. 10 2005 063 021.9 filed Dec. 30, 2005, upon which priority is claimed.

BACKGROUND OF THE INVENTION

1. Field of the Invention

The invention is directed to an improved actuator for a control unit.

2. Description of the Prior Art

In a known actuator for a throttle valve in the intake stub of an internal combustion engine (German Patent Disclosure DE 196 12 869 A1), the step-up gear disposed between the motor power takeoff shaft and the control shaft is a two-stage spur pinion gear with an intermediate wheel, which with a first toothed portion meshes with a motor pinion seated on the motor power takeoff shaft and with a second toothed portion meshes with a driving gear wheel fixedly disposed on the control shaft. The driving gear wheel and the control shaft are supported rotatably in an actuator housing that receives the control motor and the step-up gear. A restoring device assures that if the control motor fails, the throttle valve is restored to a basic position, in which only emergency operation of the engine is possible. The restoring device has a torsion spring, concentrically surrounding the control shaft and embodied as a cylindrical helical spring, and a stop piece that is received rotationally movably on the control shaft. With one spring end, the torsion spring engages the driving gear wheel, and with its other spring end it engages the stop piece and is braced axially between the driving gear wheel and the stop piece, and the stop piece in turn is braced axially on the rotary bearing, received fixedly in the actuator housing, for the control shaft. Via its spring ends, the torsion spring exerts torque on the driving gear wheel and the stop piece, and the stop piece in turn cooperates, via a stop disposed on it, with a counterpart stop disposed on the intermediate wheel. This restoring torque increases with increasing rotation of the throttle valve out of its basic position. If the control motor fails, this restoring torque rotates the throttle valve back to its basic position.

In an actuator for adjusting a throttle device in an internal combustion engine known from German Patent Disclosure DE 40 39 728 A1, the step-up gear between the motor power takeoff shaft and the control shaft is embodied as a worm gear with a worm and a circular-arclike toothed strip. The worm is disposed on the motor power takeoff shaft in a manner fixed against relative rotation, and the toothed strip is guided displaceably in the actuator housing along a circular arc. A driver arm is fixedly disposed on the control shaft and rests with one end of the arm on the face end of the toothed strip. A spiral spring seated on the control shaft presses the driver arm against the toothed segment by nonpositive engagement, so that the drive arm upon displacement of the toothed strip is pivoted and thus the control shaft with the control unit is rotated.

OBJECT AND SUMMARY OF THE INVENTION

The actuator of the invention has the advantage that because of the provision of two energy-storing means, preferably embodied as restoring springs, which are inserted separately on the input and output sides of the transmission gear and of which one feeds back to the motor power takeoff shaft and the other feeds back to the control shaft or to the control unit fixedly connected to it, a transmission gear with only one gear stage and with very major boosting can be used, without requiring the restoring force of the restoring device to be great in order to suit the high step-up ratio. Such single-stage step-up gears with a high step-up ratio, as represented for instance by a worm gear, are known also to have the disadvantage of high losses of efficiency, which in the known embodiment of the restoring device with a single energy-storing means engaging the control unit or the control shaft and being in the form of a restoring spring must additionally be compensated for by the restoring device. Not only does this mean a restoring spring that has to be dimensioned oversize and extra strong, but it also leads to the necessity of using a powerful control motor to rotate the control shaft counter to the correspondingly strong restoring force of the restoring spring. With the gain according to the invention in the restoring force of the restoring device separately for the motor power takeoff shaft and the control shaft from two energy-storing means, the high losses of efficiency of the step-up gear can also be circumvented, so that the energy-storing means can be made relatively small; this is because one energy-storing means needs to compensate only for the motor locking moment, and the other energy-storing means needs to compensate only for the useful torque at the control shaft. Circumventing the step-up gear also makes it possible to use a low-power control motor. The single-stage transmission gear, the small control motor, and the two energy-storing means embodied preferably as restoring springs have an advantageous effect in terms of saving installation space, reducing weight, and low production costs. It is furthermore possible, as a step-up gear, also to use gears of the kind that because of their high step-up have self-locking. In actuators with such a gear, conventional restoring devices could not be used for shifting the control unit to a basic position in the event that the control motor fails.

In a preferred embodiment of the invention, between the motor power takeoff shaft and the energy-storing means feeding back to it, a step-down gear is disposed, which is preferably a crown gear, with a spur pinion fixedly disposed on the motor power takeoff shaft and a contrate gear meshing with the spur pinion, the wheel axis of the contrate gear being oriented perpendicular to the motor power takeoff shaft. The energy-storing means feeding back to the gear output of the crown gear is embodied as a restoring spring, which with one spring end is fixed to the contrate gear and with its other spring end is fixed in stationary fashion. The crown gear—like a spur pinion gear—has hardly any losses of efficiency and makes it possible to tense the restoring spring over a plurality of revolutions of the motor power takeoff shaft, these revolutions being of the kind necessary for adjusting the control unit.

BRIEF DESCRIPTION OF THE DRAWINGS

The invention will be better understood and further objects and advantages thereof will become more apparent from the ensuing detailed description of a preferred embodiment, taken in conjunction with the drawings, in which.

DESCRIPTION OF THE PREFERRED EMBODIMENT

Figure 1:
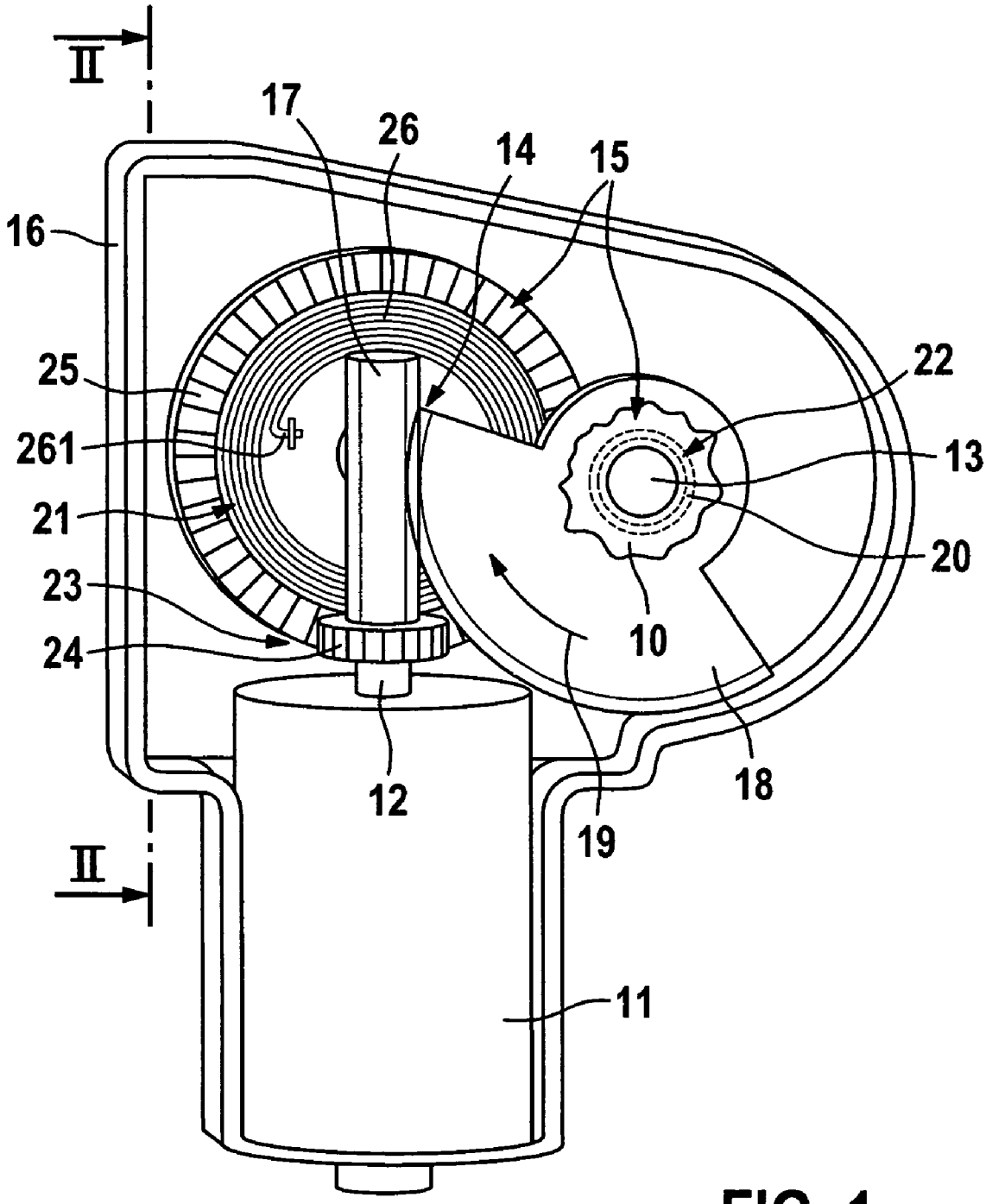
FIG. 1 is a schematic perspective side view of an actuator for a control unit.
Figure 2:
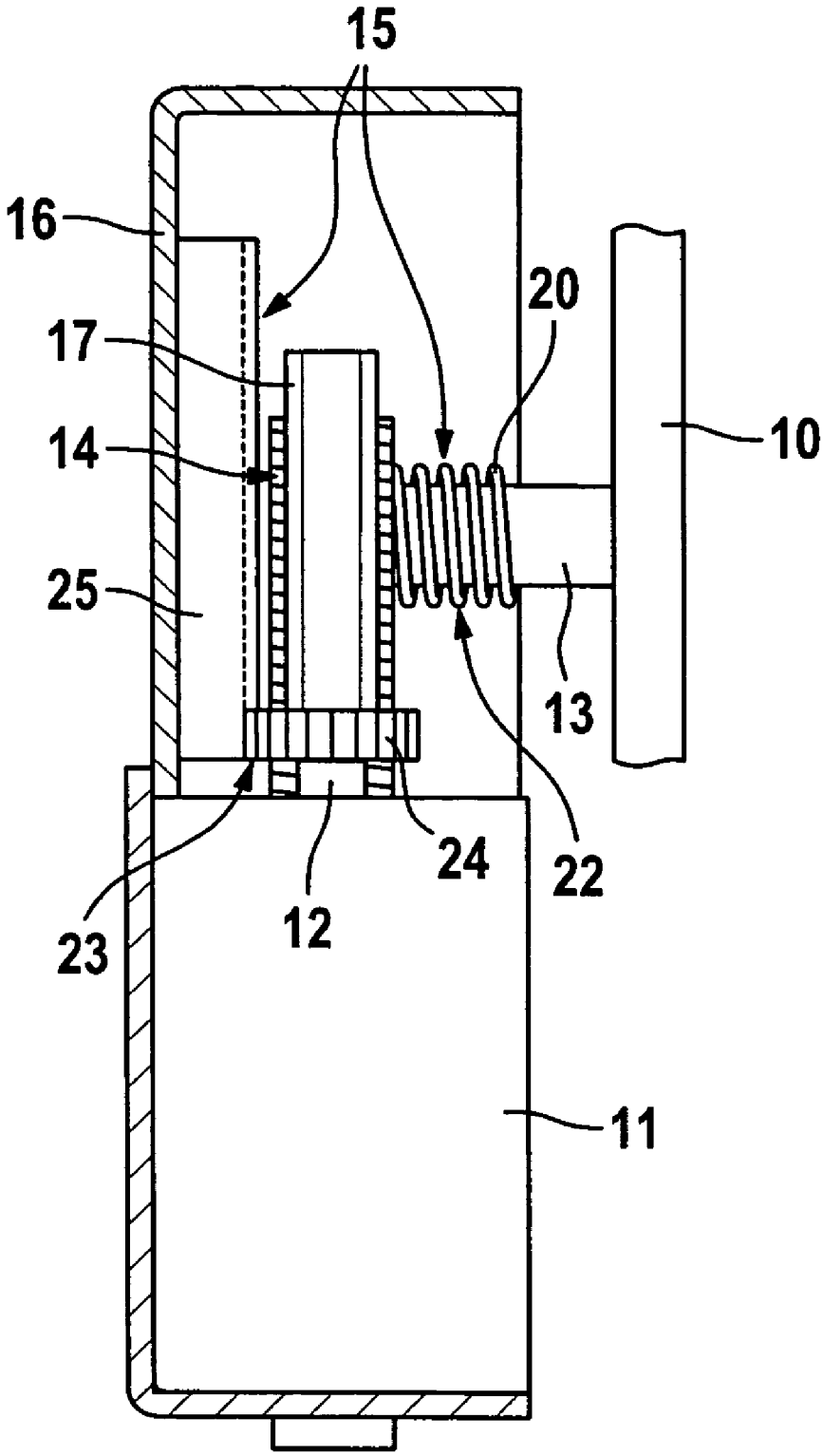
FIG. 2 is a schematic section taken along the line II-II in FIG. 1, with the control unit shown in fragmentary form.

The actuator shown in FIGS. 1 and 2 for a control unit 10 (FIG. 2) includes an electric control motor 11 with a motor power takeoff shaft 12; a control shaft 13; a step-up gear 14, disposed between the motor power takeoff shaft 12 and the control shaft 13; and a restoring device 15, for restoring the control unit 10 to a basic position if the control motor 11 is defective or fails. The control unit 10 may be a throttle valve in the intake stub of an internal combustion engine, an air valve in an air conditioner, or some other pivotable element for controlling a cross section of a conduit. The control unit 10 is shown in fragmentary form in FIG. 2.

The control motor 11 and the step-up gear 14 are received in a shell-like actuator housing 16. The control shaft 13 is supported rotationally in the actuator housing 16. The step-up gear 14 is embodied as a worm gear, which has a worm 17, seated on the motor power takeoff shaft 12, and a worm wheel 18. The worm wheel is disposed on the control shaft 13 in a manner fixed against relative rotation. Since the control unit 10 executes only a limited pivoting motion, the worm wheel 18 is embodied as a wheel segment, and the wheel toothing extends over a circular arc of less than 180°.

The restoring device 15 has a first restoring spring 21, acting as a first energy-storing means, that is operative on the input side of the step-up gear 14 and a second restoring spring 22, acting as a second energy-storing means, that is operative on the output side of the step-up gear 14. The second restoring spring 22 is embodied as a torsion spring, preferably as a cylindrical helical spring. It is dimensioned such that it is capable of overcoming the useful torque that can be picked up at the control shaft 13. The first restoring spring 21, conversely, is designed such that it is capable of overcoming the motor locking moment. The first restoring spring 21 is in operative engagement with the motor power takeoff shaft 12 via a step-down gear 23. The step-down gear 23 is preferably embodied as a crown gear, with a spur pinion 24 fixedly disposed on the motor power takeoff shaft 12 and with a contrate gear 25, rotationally supported in the actuator housing 16, that is in toothed engagement with the spur pinion 24. The first restoring spring 21, in the exemplary embodiment, is embodied as a spiral spring 26, which with one spring end 261 is secured to the contrate gear 25 and with its other spring end is secured to the actuator housing 16. The spiral spring 26 is preferably disposed at the base of the contrate gear 25, and with its spring end, not visible in FIG. 1, that is secured to the actuator housing 16, it protrudes through a curved slot in the base of the contrate gear 25. It is understood to be possible for both restoring springs 21, 22 to be embodied as spiral springs or cylindrical helical springs.

in FIG. 1, the actuator is shown as an example in a position in which the control unit 10 in its basic position. The control motor 11 is switched to be currentless. If the motor is switched on with a direction of rotation such that the motor power takeoff shaft 12 rotates clockwise, then via the rotating worm 17, the worm wheel 18 is pivoted in the direction of the arrow 19. Simultaneously, via the rotating spur pinion 24, the contrate gear 25 is rotated in such a way that the initial torque of the spiral spring 26 increases. By the pivoting of the worm wheel 18, the control shaft 13 is rotated, which in turn pivots the control unit 10 into a position in which it more or less widely opens a flow cross section that is to be controlled. With the rotation of the worm wheel 18 and the control shaft 13, the cylindrical helical spring 20 is tensed. If in this position of the control unit 10 the control motor 13 becomes currentless because of a defect, then the prestressed helical spring 20 rotates the control shaft 13 as well as the worm wheel 18, and the prestressed spiral spring 26 rotates the contrate gear 25 and via the spur pinion 24, the motor power takeoff shaft 12 back again. As a result, the control unit 10 is restored to its basic position, and the worm gear with its major step-up, high losses of efficiency, and possible self-locking is circumvented.

It is understood to be possible to dispense with the crown gear and to have the first energy-storing means, that is, the first restoring spring, of the restoring device act directly on the motor power takeoff shaft. However, in that case the control motor 11 must be allowed to execute only a few revolutions for adjusting the control unit 10.

The foregoing relates to a preferred exemplary embodiment of the invention, it being understood that other variants and embodiments thereof are possible within the spirit and scope of the invention, the latter being defined by the appended claims.

We claim:

1. An actuator for a control unit, comprising:

an electric control motor having a motor power takeoff shaft;

a control shaft rotating the control unit;

a transmission gear, disposed between the motor power takeoff shaft and the control shaft; and a restoring device for restoring the control unit to a basic position if the control motor fails, wherein the restoring device comprises two separate energy-storing means, a first energy-storing means which acts on the motor power takeoff shaft between the control motor and the transmission gear and a second energy-storing means which acts on the control shaft between the gear and the control unit.

2. The actuator as defined by claim 1, wherein the first energy-storing means acts on the motor power takeoff shaft for overcoming a motor locking moment, and the second energy-storing means acts on the control shaft for overcoming useful torque of the control shaft.

3. The actuator as defined by claim 2, wherein the transmission gear is embodied as a worm gear, with a worm disposed on the motor power takeoff shaft and a worm wheel disposed fixedly on the control shaft, the control shaft being oriented perpendicular to the motor power takeoff shaft.

4. The actuator as defined by claim 2, further comprising a second transmission gear disposed between the motor power takeoff shaft and the first energy-storing means, the first energy-storing means being coupled to a gear output of the second transmission gear.

5. The actuator as defined by claim 2, wherein the first energy-storing means is embodied as a first restoring spring.

6. The actuator as defined by claim 5, wherein the first restoring spring is a spiral spring, located in a second transmission gear, one spring end of which is secured to a contrate gear and the other spring end of which is held in stationary fashion.

7. The actuator as defined by claim 1, wherein the transmission gear is embodied as a worm gear, with a worm disposed on the motor power takeoff shaft and a worm wheel disposed fixedly on the control shaft, the control shaft being oriented perpendicular to the motor power takeoff shaft.

8. The actuator as defined by claim 7, further comprising a second transmission gear disposed between the motor power takeoff shaft and the first energy-storing means, the first energy-storing means being coupled to a gear output of the second transmission gear.

9. The actuator as defined by claim 1, further comprising a second transmission gear disposed between the motor power takeoff shaft and the first energy-storing means, the first energy-storing means being coupled to a gear output of the second transmission gear.

10. The actuator as defined by claim 9, wherein the second transmission gear comprises a spur pinion, disposed fixedly on the motor power takeoff shaft, and a contrate gear, meshing with the spur pinion, with a wheel axis oriented perpendicular to the motor power takeoff shaft; the first energy-storing means being connected to the contrate gear.

11. The actuator as defined by claim 9, wherein the first energy-storing means is embodied as a first restoring spring.

12. The actuator as defined by claim 11, wherein the first restoring spring is a spiral spring, located in a second transmission gear, one spring end of which is secured to a contrate gear and the other spring end of which is held in stationary fashion.

13. The actuator as defined by claim 1, wherein the first energy-storing means is embodied as a first restoring spring.

14. The actuator as defined by claim 13, wherein the first restoring spring is a spiral spring, located in a second transmission gear, one spring end of which is secured to a contrate gear and the other spring end of which is held in stationary fashion.

15. The actuator as defined by claim 14, wherein the second energy-storing means is a torsion spring, concentrically surrounding the control shaft, preferably a cylindrical helical spring or a spiral spring, one spring end of which is secured to the control shaft or the control unit and the other spring end of which is held in stationary fashion.

16. The actuator as defined by claim 13, wherein the second energy-storing means is a torsion spring, concentrically surrounding the control shaft, preferably a cylindrical helical spring or a spiral spring, one spring end of which is secured to the control shaft or the control unit and the other spring end of which is held in stationary fashion.

17. The actuator as defined by claim 13, wherein the transmission gear and the second transmission gear are received in an actuator housing in which a wheel axis of the contrate gear is held and the control shaft is supported rotationally; and wherein spring ends, held in stationary fashion, of the restoring spring are secured in the actuator housing.

18. The actuator as defined by claim 17, wherein the control motor is received in the actuator housing.

* * * * *